US006969323B1

(12) United States Patent
von Bose et al.

(10) Patent No.: US 6,969,323 B1
(45) Date of Patent: Nov. 29, 2005

(54) AMUSEMENT RIDE

(76) Inventors: Robert Joseph von Bose, 1428 N. Main St., Mansfield, TX (US) 76063; Joseph Walter von Bose, 3212 Roosevelt Dr., Arlington, TX (US) 76016

( * ) Notice: Subject to any disclaimer, the term of this patent is extended or adjusted under 35 U.S.C. 154(b) by 0 days.

(21) Appl. No.: 10/898,411

(22) Filed: Jul. 23, 2004

Related U.S. Application Data

(60) Provisional application No. 60/494,949, filed on Aug. 13, 2003.

(51) Int. Cl.[7] ..... A63G 27/08

(52) U.S. Cl. ..... 472/30; 472/44

(58) Field of Search ..... 472/3, 30, 43, 472/44, 47, 130, 135; 104/55, 77, 78, 85

(56) References Cited

U.S. PATENT DOCUMENTS

| | | | | |
|---|---|---|---|---|
| 4,775,144 | A * | 10/1988 | Shipman | 472/44 |
| 5,319,897 | A | 6/1994 | Royer | |
| 5,445,564 | A * | 8/1995 | Kastner | 472/3 |
| 5,558,582 | A * | 9/1996 | Swensen et al. | 472/43 |
| 5,803,816 | A * | 9/1998 | Moser et al. | 472/46 |
| 6,477,961 | B1 | 11/2002 | Mares | |

* cited by examiner

*Primary Examiner*—Kien Nguyen

(57) ABSTRACT

An amusement ride combining rotational motion, linear motion, and tumbling motion. Rotational motion and linear motion are independently variable and tumbling motion is added at patrons option. For ride patrons this offers a wide variety of acceleration and speed experiences in a single ride. For ride operators this offers a ride that can give a mild ride to one group of patrons and follow it with a wild ride to the next group by merely changing velocities. For ride owners the ride gives a large patrons-per-hour capacity in a relatively small operating area.

3 Claims, 5 Drawing Sheets

AMUSEMENT RIDE

CROSS-REFERENCE TO RELATED APPLICATIONS

Provisional Patent Appl. No. 60/494,949 dated Aug. 13, 2003, Robert Joseph von Bose and Joseph Walter von Bose, Amusement Ride.

FEDERALLY SPONSORED RESEARCH

Not Applicable

SEQUENCE LISTING OR PROGRAM

Not Applicable

BACKGROUND OF THE INVENTION

Field of the Invention

This invention relates to an amusement ride, specifically to a ride combining circular motion and linear motion, and adding tumbling motion at the riders option.

BACKGROUND OF THE INVENTION

Amusement parks vie for attendance by offering a variety of rides with varying magnitude and direction of speed and acceleration designed to give each patron a thrill within, or slightly beyond, that patron's comfort zone. Speed and acceleration range from small carousels with horses moving up and down to major roller coasters with loops and twists. These existing rides give the patron significant speed and acceleration in only one seated attitude and a subsequent ride is a copy of the first. Providing the patron variety in magnitude and direction of speed and acceleration with many diverse patterns in a single ride is the ride manufacturer's competitive challenge.

BACKGROUND OF THE INVENTION—OBJECTIVE

The major objective of the present invention is to provide the patron with a unique experience, not possible with any existing ride known to us, by combining the variable rotation rate of a large wheel with the variable linear speed of this wheel and giving the patron the option of locking the seat module to its support, thus tumbling with the wheel, in any pitch attitude.

DRAWINGS—FIGURES

Figure 1:
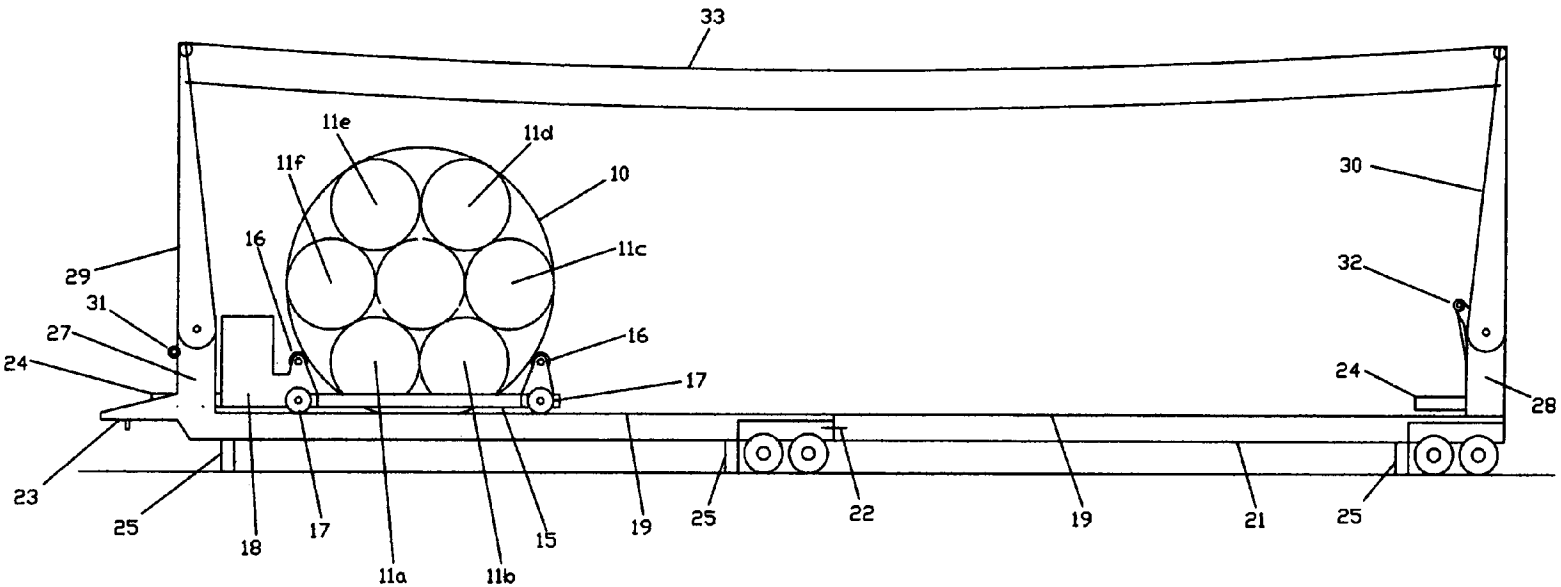

FIG. 1 mobile embodiment set up for operation.

Figure 2:
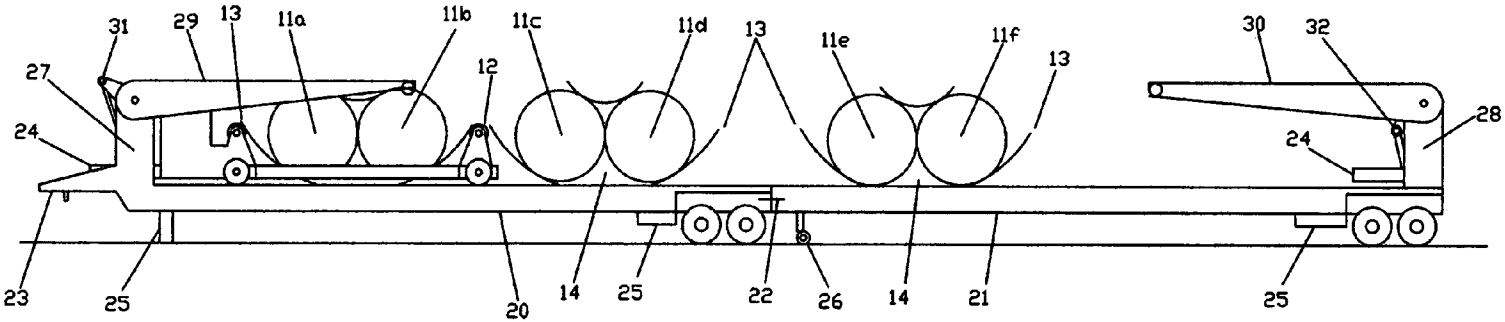

FIG. 2 mobile embodiment broken down for transport to another site.

Figure 3:
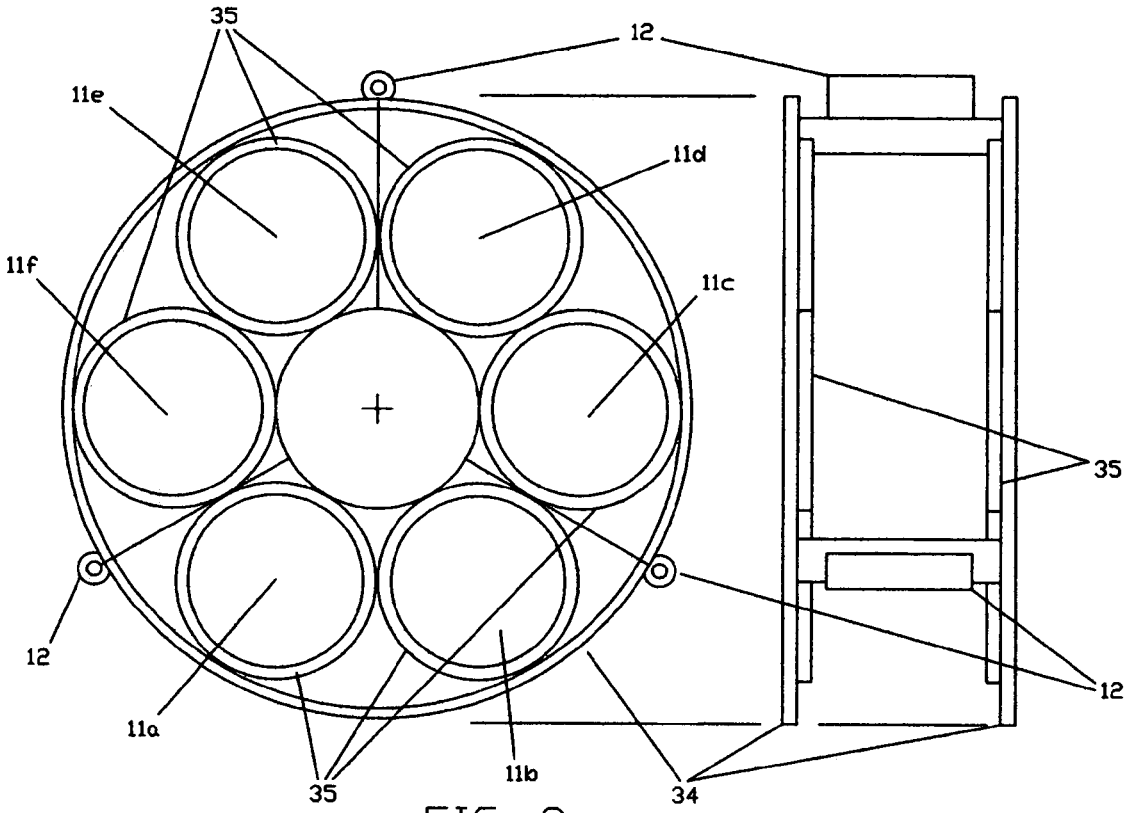

FIG. 3 structural rotor in greater detail.

Figure 4:
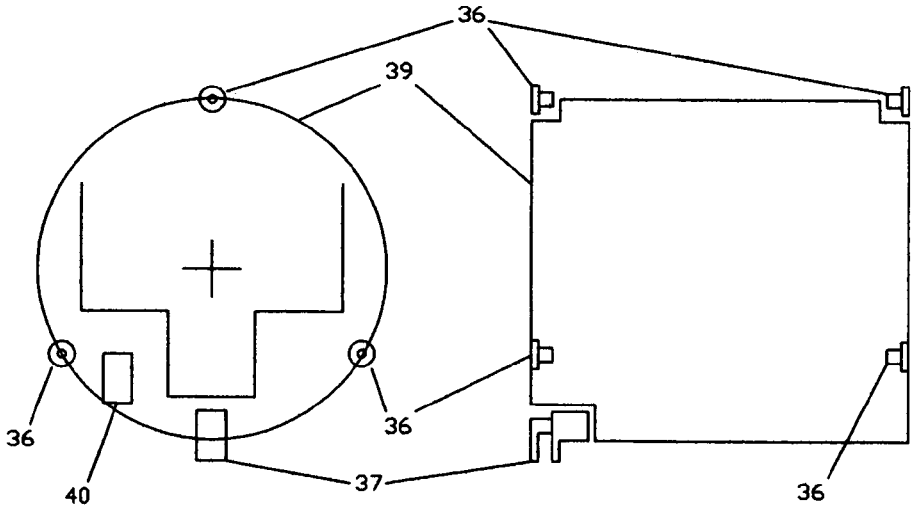

FIG. 4 seat module in greater detail.

Figure 5:
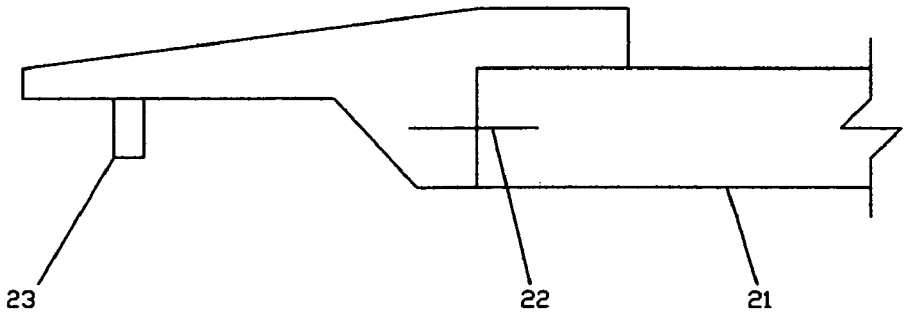

FIG. 5 aft trailer towing provisions in greater detail.

Figure 6:
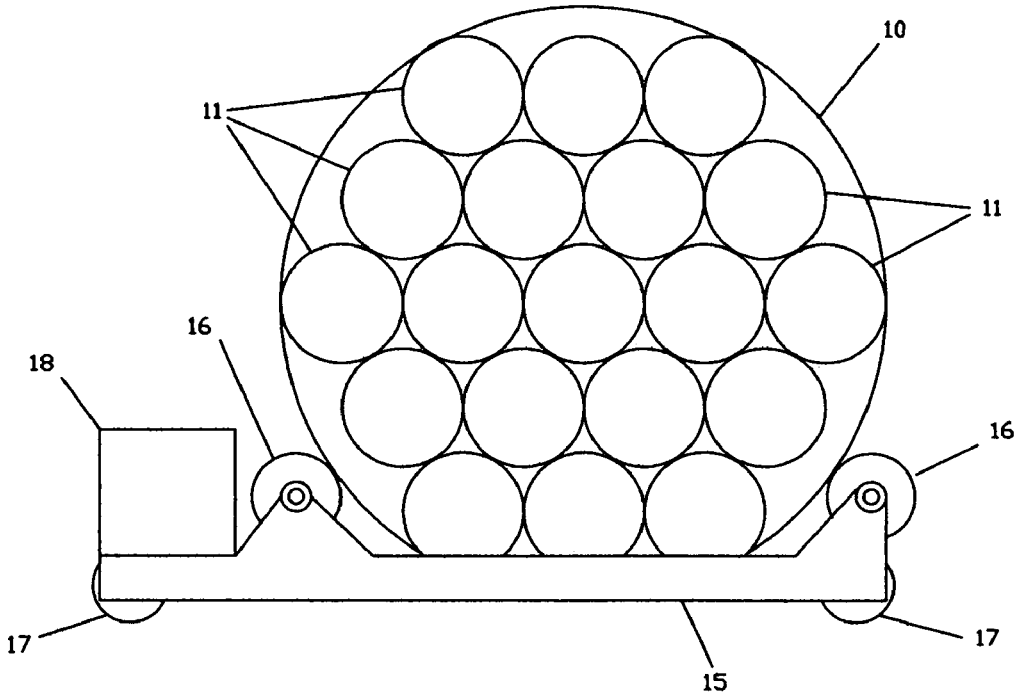

FIG. 6 single-site embodiment for operation on roadway or railway.

Figure 7:
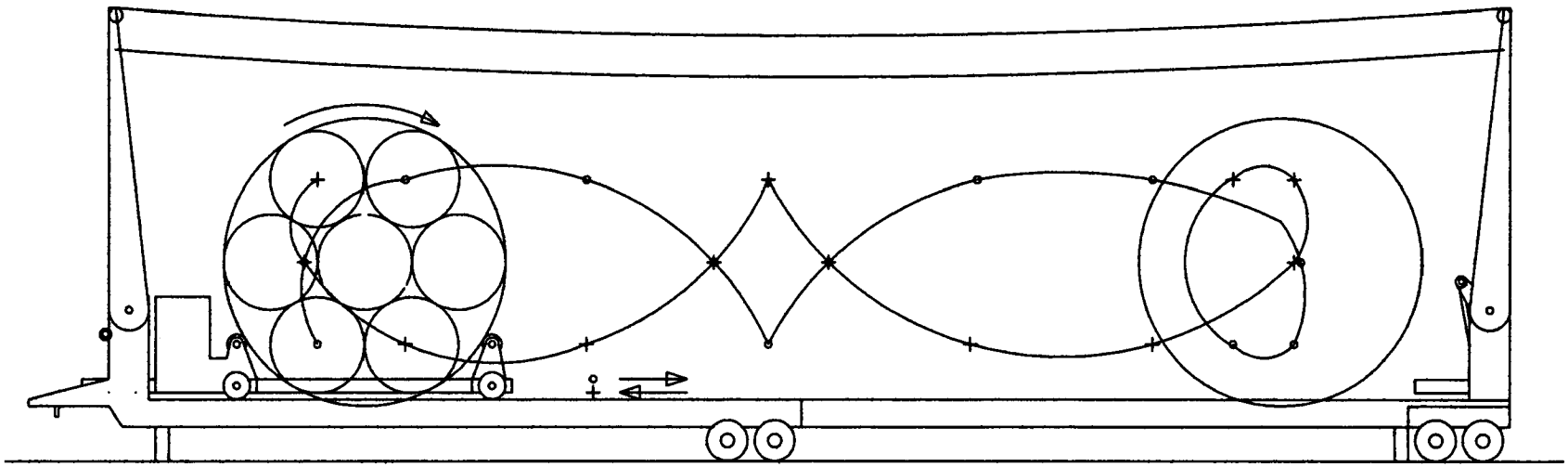

FIG. 7 path of one seat module during one ride cycle.

Figure 8:
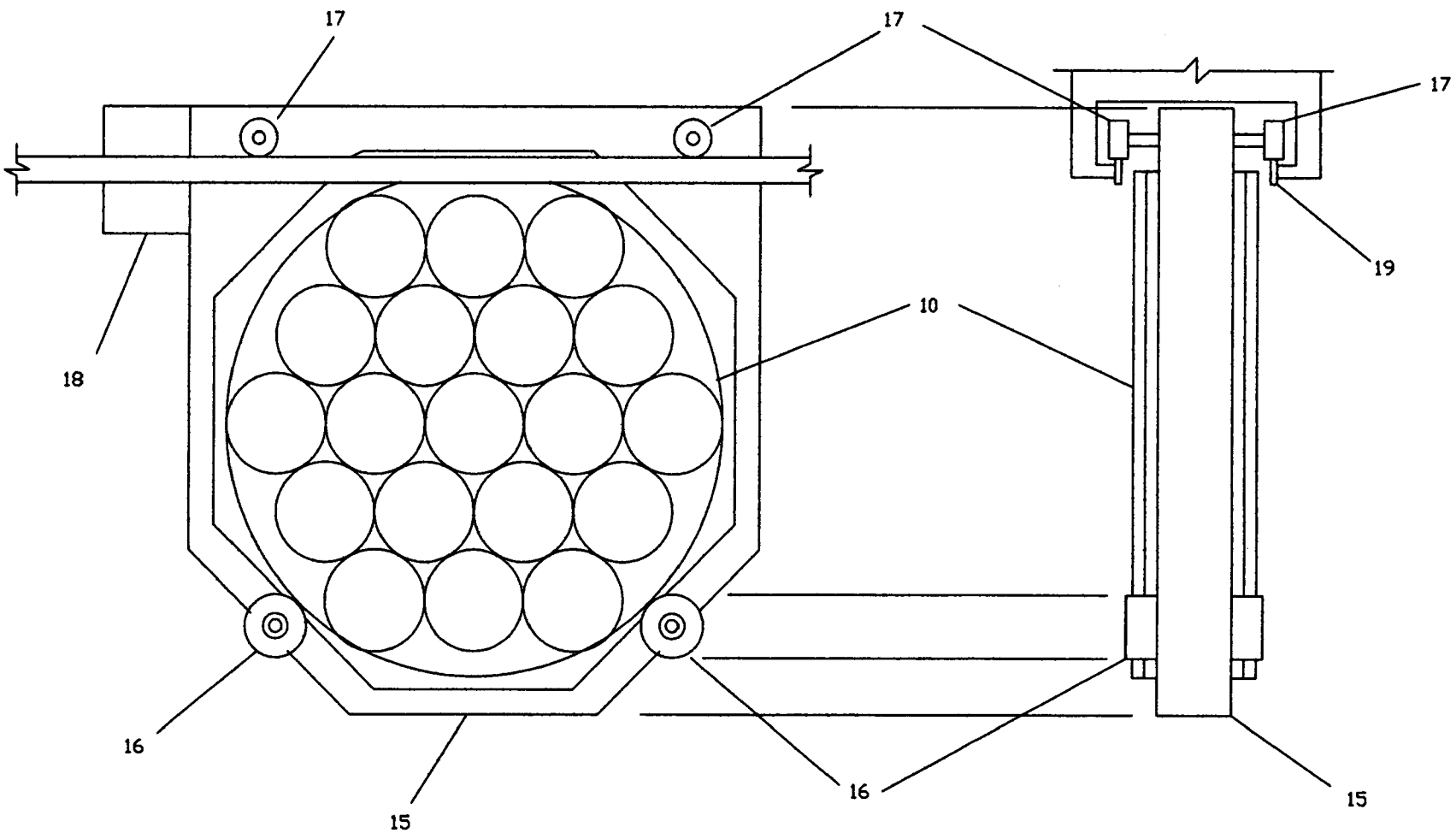

FIG. 8 fixed site embodiment for operation on elevated rails.

DRAWINGS—REFERENCE NUMERALS

In the drawings, parts or assemblies which are identical and serve the same purpose but used in different locations have the same number but different alphabetic suffixes to clarify the set-up and break-down procedures.

| | | | |
|---|---|---|---|
| 10 | structural rotor | 11 | seat module |
| 12 | hinge | 13 | binge half |
| 14 | transport cradle | 15 | carriage |
| 16 | wheel support roller | 17 | carriage wheel |
| 18 | control and power unit | 19 | rail |
| 20 | forward trailer | 21 | aft trailer |
| 22 | trailer coupling pins/fasteners | 23 | tractor coupling |
| 24 | snubber | 25 | outrigger |
| 26 | trailer casters | 27 | forward boom base |
| 28 | aft boom base | 29 | forward boom |
| 30 | aft boom | 31 | forward boom actuator |
| 32 | aft boom actuator | 33 | lights and/or banners |
| 34 | outer ring | 35 | seat module track |
| 36 | seat module wheel | 37 | brake mechanism |
| 38 | fifth wheel adapter | 39 | seat module envelope |
| 40 | seat service connector | 41 | seat module |

DETAILED DESCRIPTION—FIGS. 1 THROUGH 5—PREFERRED EMBODIMENT

Preferred embodiment of the ride is illustrated in FIG. 1 set up ready for operation and in FIG. 2 broken down for transport. Patrons are accommodated within structural rotor 10 seated in seat modules 11. Structural rotor 10 has circular outer rings 34 contoured to be safely restrained and driven by support rollers 16. Support rollers 16 are structurally mounted on carriage 15. One or more of support roller 16 are driven in either direction of rotation at any desired speed by conventional motors powered from control and power unit 18 through conventional controls.

Carriage 15 has carriage wheels 17 suitably contoured to rest upon and be laterally restrained by rails 19 attached to forward trailer 20 and aft trailer 21. One or more carriage wheels 17 are driven in either direction of rotation at any desired speed by conventional motors and controls within control and power unit 18. Conventional snubbers 24 protect against violent stops at either end.

Forward trailer 20 is equipped with forward boom 29 hinge mounted to boom base 27 structurally attached near the forward end of the trailer. Forward boom 29 is moved between a vertical position (FIG. 1) and a horizontal stowed position (FIG. 2) by forward boom actuator 31. Aft trailer 21 is equipped with aft boom 30 hinge mounted to aft boom base 28 structurally attached near the aft end of the trailer. Aft boom 30 is moved between a vertical position (FIG. 1) and a stowed horizontal position (FIG. 2) by aft boom actuator 32. Forward boom 29 and aft boom 30 are each equipped with conventional winch, pulleys and line. In operational configuration (FIG. 1) forward boom 29 and aft boom 30 support a string of lights and/or banners 33.

In operational configuration (FIG. 1) forward trailer 20 is laterally stabilized by outriggers 25. Aft trailer 21 is laterally stabilized by outriggers 25 near the aft corners and by mating trailer coupling pins/fasteners 22 to forward trailer 20. Aft trailer 21 is equipped with fold-down trailer casters 26.

Structural rotor 10 is assembled from three sections (FIG. 3). Each section consists of two seat modules 11. First section contains seat modules 11*a* and 11*b*. Second section contains seat modules 11*c* and 11*d*. Third section contains seat modules 11*e* and 11*f*. Each section is joined to each adjacent section by a hinge 12 and additional fasteners as required. When disconnected by pulling the hinge pin each section retains a hinge half 13.

Seat module 11 (FIG. 4) has six seat module wheels and brake mechanism 37 positioned to match seat module track 35. The seat module has a seat service connector 40 which locks the module from rotating during loading-unloading and connects the restraint seat (by others) to the electrical, hydraulic, pneumatic, or safety services as required by such seat. One half of seat service connector 40 mounts on seat module 11 and the matching half mounts on carriage 15 convenient to operation by an attendant. The seat module structure ties all these components together. It cannot be detailed since a major requirement, restraint seat hard mounting points, is to be determined. The seat module envelope 39 shows the volume within it is fitted.

Conventional tractor coupling 23 (FIG. 5) is fastened to the forward end of aft trailer 21 with mating trailer coupling pins/fasteners 22 and such additional fasteners necessary to support the ride and such additional loads as a customer may specify.

Detailed Design—FIG. 6—Alternative Embodiment, Rail or Roadway

An embodiment of the ride not requiring highway transport is shown in FIG. 6. It is operated on rails or paved surface (site specific) and loaded-unloaded by a multilevel loading structure (site specific) from one or both sides. This embodiment is not limited in height nor width nor number of seat modules 11.

Detailed Design—FIG. 8—Alternative Embodiment, Elevated Rail

An embodiment for operation on elevated rails is shown in FIG. 8. The carriage 15 looks quite different from other embodiments but performs all the same functions. The embodiment requires an elevated rail support structure which is site-specific and supplied by others.

Operation—FIGS. 1 and 2—Break-Down and Erection

To convert from operational configuration (FIG. 1) to transport configuration (FIG. 2) all lights and/or banners 33 are removed. Any other encumbrances are removed. Carriage 15 is securely attached to forward trailer 20. The 11*a*–11*b* section of structural rotor 10 is securely attached to carriage 15. Booms 29 30 are securely locked in vertical position. Winches on each boom let out line and cargo hooks are connected to appropriately placed anchors on 11*c*–1*f* section of structural rotor 10. All fasteners between sections 11*a* and 1*f* and between sections 11*b* and 11*c* are removed except for the pin in hinge 12 joining 11*b* with 11*c*. Transport cradle 14 is placed on rails 19 to receive the 11*c*–11*d* section of structural rotor 10. Line to aft boom 30 is pulled to swing upper portion of structural rotor 10 up and aft pivoting on hinge 12 between sections 11*b* and 11*c*. Forward boom 29 pays out line while maintaining a small stabilizing tension. As the center of gravity of the folding portion passes beyond the hinge point, control passes to forward boom 29. Boom 29 pays out line slowly to lower the folding portion on to transport cradle 14 while aft boom 30 maintains a small stabilizing tension. Transport cradle 14 is securely attached to rails 19. Section 11*c*–11*d* of structural rotor 10 is securely attached to transport cradle 14.

Lines on forward boom 29 and aft boom 30 are adjusted and cargo hooks are connected to appropriately placed anchors on 11*e*–11*f* section of structural rotor 10. Both booms apply a slight tension to lines. All fasteners between 11*d* and 11*e* are removed except for the pin in hinge 12. Transport cradle 14 is positioned on rails 19 to receive section 11*e*–11*f* of structural rotor 10. Forward boom 29 pays out line slowly to lower section 11*e*–11*f* of structural rotor 10 on to transport cradle 14 while aft boom 30 maintains a stabilizing tension. Pin in hinge 12 between sections 11*d* and 11*e* is removed. Section 11*e*–11*f* of structural rotor 10 is securely attached to transport cradle 14. Line from aft boom 30 is used to pull transport cradle 14 aft to clear the coupling between forward trailer 20 and aft trailer 21. Transport cradle 14 is securely attached to rails 19. Lines of forward boom 29 and aft boom 30 are hauled in and secured. Both booms are lowered to transport position and secured.

Outriggers 25 and trailer casters 26 are adjusted and a conventional tractor is connected to conventional tractor coupling 23. Trailer coupling pins/fasteners 22 are disconnected. Outriggers 25 on forward trailer 20 are retracted and stowed. Conventional brake and light lines are connected between tractor and forward trailer 20 and it is towed to clear area forward of aft trailer 21.

Fifth wheel adapter 38 is installed on aft trailer 21. Outriggers 25 and trailer casters 26 are adjusted and a conventional tractor is connected to fifth wheel adapter 38. Outriggers 25 and trailer casters 26 are retracted and stowed. Conventional brake and light lines are connected between tractor and aft trailer 21 and it is ready for towing.

To convert from transport configuration (FIG. 2) to operational configuration (FIG. 1) perform the preceding operations in reverse order and each operation substantially in reverse.

Operation—FIG. 1—Loading, Running, and Unloading

Ride operator moves seat modules 11*a* and 11*b* into loading position. Attendant connects seat service connectors 40 and looks for evidence of malfunction, visually and by displays. Attendant opens seat module 11*a* and 11*b* doors, unlocks seat restraints (by others), and assists patrons in unloading. Attendant assists next patrons in loading, observes patrons connection of restraint provisions of the seat, completes restraint connections as required, and locks restraints. Attendant locks doors of seat modules 11*a* and 11*b* and disengages seat service connectors 40. The foregoing routine is repeated for seat modules 11*c* and 11*d* and for seat modules 11*e* and 11*f*.

Attendant signals ride operator of readiness for departure. Ride operator visually checks status. Ride operator controls rotation of structural rotor 10 and speed of carriage 15 back and forth between snubbers 24 observing limitations necessary to avoid excessive accelerations on patrons. During this time patrons in any seat module 11 may, by unanimous consent, operate the brake mechanism which causes that seat module to remain fixed with relation to seat module track 35 thus tumbling its patrons in its angular position relative to structural rotor 10 at the time the brake was applied. Any patron in that seat module may release the brake at any time. Ride operator moves the carriage to the loading platform (by others) at which point this sequence is repeated.

Advantages—FIG. 7

This amusement ride meets our stated objective of giving the patron a wide variety of sensations in a single ride. The variety of ride profiles made available to the patron will be more easily demonstrated by reference to FIG. 7 showing one ride cycle as viewed from the left side of the ride. Two words for defining direction of rotation, peculiar to dynamics and astronomy, are used: "direct", a direction of rotation which would cause the body to travel in the direction of linear motion if rolling on a floor; and "retrograde", a direction of rotation which would cause the body to travel opposite to the linear motion if rolling on a floor.

The illustrated cycle begins with the structural rotor turning in a clockwise direction at a rate that will complete two turns while traveling the length of the track. The path shown is that of the center of the seat module which is at 7 o'clock as the operator puts the carriage in motion toward the aft end of the trailer. This gives direct rotation on the trip aft and retrograde rotation on the trip back. The path accounts for an easy acceleration of the carriage to a maximum velocity in the middle half of the track, an easy deceleration to the end, a 120 degree rotation while the carriage is switched to return, an easy acceleration to maximum velocity in the middle half of the track, and an easy deceleration to the point of beginning. The markers along the path (circles aft bound, crosshairs forward bound) show calculated locations in progressive 60 degree increments of rotation of the structural rotor.

The seat module at 7 o'clock first moves almost straight upward as the carriage moves slowly. The module sweeps speedily across the top of its arc where carriage linear velocity and direct rotation are additive. The module rapidly decelerates and moves very slowly near its lowest point where direct rotation subtracts from carriage linear velocity. The module sweeps speedily across the top of another arc then slowly descends as the carriage stops and reverses.

As the carriage starts forward the module, now at 11 o'clock, goes over the top, slowly descends, then rushes forward in a low arc where the rotation, now retrograde, adds to carriage linear velocity. The module slowly rises, passes its highest point, slowly descends again, and enters another rush forward. Approaching the forward end of the track the module rises slowly to 11 o'clock.

Only the patrons in the seat module starting at the 7 o'clock position experience this ride profile. Assume for simplicity two rows of seats facing each other within the module and the module free to rotate within its seat module track thus aligning with gravity with minor oscillations. There are, then, two distinctly different acceleration and velocity patterns within this one seat module; one group experiences it facing forward and one group experiences it facing aft.

Patrons in each of the other five seat modules follow a profile unique to that module and in each some face forward and some face aft. Thus there are twelve different experiences from this one combination of structural rotor angular rate and carriage speed on a single round trip. The seat module that started the first cycle from 7 o'clock is now at 11 o'clock so on the second round trip the experience will be different from the first.

The motion profile shown in FIG. 7 will only exhibit this precise symmetry if the structural rotor turns exactly twice on the trip down the track. When the operator selects a retrograde rotation to begin the cycle, the seat at 7 o'clock immediately enters an arc similar to the last approach arc of FIG. 7 and approximates the remainder of that cycle but in the other direction. With any fixed peak velocity of the carriage, speeding up the rotation of the structural rotor shortens the time between minimum velocity points and maximum velocity points thus increasing the acceleration forces on the patrons. With any fixed rotation rate of the structural rotor, increasing the peak velocity of the carriage also increases the acceleration forces on the patrons.

The complete profile of speed and accelerations felt by any one patron depends on the fixed dimensions of the specific ride and these variables: the rotational rate of the structural rotor, the velocity of the carriage, the location of the seat module occupied by that patron, and whether the patron is initially seated facing forward or facing aft. Variety? A patron would have to plan very carefully to get two identical experiences.

The brake mechanism may be actuated by the patrons of any seat module at their option. They may lock it up tight at any pitch attitude they choose. They may release it at any pitch attitude. They may choose to try to release the brake when exactly upside down and see which way they swing. The number of possible combinations is awesome. Variety? This amusement ride has it.

Scope

The many specifications contained in the description above should not be construed as limiting the scope of the invention but as merely providing illustrations of some preferred embodiments of a much broader invention. For example, detail design of a seat module simply cannot be done until a buyer specifies the restraint seat of his choice because the location of hard mounting points of said seat dictate much of the structure. Also, legal restrictions of jurisdictions within which a buyer wishes to operate may dictate the dimensions of the operational or transport configurations of a mobile embodiment, dimensions of a ride for fixed base installation, or require special loading and unloading provisions.

Thus the scope of the invention should be determined by the appended claims and legal equivalents rather than by the examples given.

We claim:

1. An amusement ride, comprising:

(a)a substantially cylindrical rotor means rotatably mounted on a carriage means which rolls on a plurality of carriage wheels, (b)said rotor means having rotatable mounting means for a plurality of seat modules, (c)said seat modules each having accommodation means selected from the group consisting of restraint seats and benches for a plurality of ride patrons, (d)controllable braking means selected from the group consisting of caliper and shoe brakes with mechanical and electrical and pneumatic and hydraulic activation to prevent relative motion between said seat module and said rotor means, (e)power means selected from the group consisting of electric motors and piston engines and turbine engines, each with matching speed control, and controllably coupled transmission means selected from the group consisting of geared transmissions and planetary transmissions and friction transmissions and hydraulic transmissions, each with integral ratio and directional shifting, connected to drive said rotor means, (f)power means selected from the group consisting of electric motors and piston engines and turbine engines, each with matching speed control, and controllably coupled transmission means selected from the group consisting of geared transmissions and planetary transmissions and friction transmissions and hydraulic transmissions, each with integral ratio and directional shifting, connected to drive said carriage means, whereby said rotor means imparts a circular motion to said patron, said carriage means imparts a linear motion to said patron, and said braking means allows patron to add tumbling motion, whereby independent variation of circular motion, linear motion, and tumbling motion gives said patron an almost infinite variety of acceleration and speed experiences.

2. Amusement ride of claim 1, further comprising track means selected from the group consisting of tracks and rails and ways and bars disposed substantially horizontally and straight along extended transportation means selected from the group consisting of trailers and dollies and stands and piers, said track means matching contour and spacing of said carriage wheels, whereby said amusement ride may be substantially extended in length while remaining readily prepared for transport, transported from site to site, and prepared for operation at a new site.

3. Amusement ride of claim 2, further comprising:

(a)said rotor means provided with disconnecting means selected from the group consisting of hinge halves and flanges and splice plates and straps and laps and hinging means selected from the group consisting of hinges and pivot pins and flexible links at appropriate locations, (b)load handling means selected from the group consisting of booms and masts and hoists and cranes attached to transportation means selected from the group consisting of trailers and dollies located to break down and stow folded and disconnected elements, and (c)cradling means selected from the group consisting of cradles and chocks and braces and frames to support folded and dismantled elements on said transportation means, whereby said amusement ride may be prepared for transport, transported from site to site in a more compact form, and prepared for operation expeditiously.

* * * * *